US005366310A

United States Patent [19]

Armelles Flors

[11] Patent Number: 5,366,310

[45] Date of Patent: Nov. 22, 1994

[54] TOOTHBRUSH WITH SLIDE IN SUPPLY

[76] Inventor: Luisa Armelles Flors, Artana, 2-7°, Castellon, Spain, 12005

[21] Appl. No.: 13,974

[22] Filed: Feb. 4, 1993

[30] Foreign Application Priority Data

Feb. 7, 1992 [ES] Spain ..... 9200260
Dec. 24, 1992 [ES] Spain ..... 9202612

[51] Int. Cl.[5] ..... A46B 11/00; A46B 11/02

[52] U.S. Cl. ..... 401/132; 401/268; 401/288; 401/290

[58] Field of Search ..... 401/132, 268, 288, 290

[56] References Cited

U.S. PATENT DOCUMENTS

| | | | |
|---|---|---|---|
| 1,811,833 | 6/1931 | Simon | 401/132 |
| 1,947,720 | 2/1934 | Laub . | |
| 1,947,721 | 2/1934 | Laub . | |
| 2,932,044 | 4/1960 | Woodrow | 401/268 X |
| 3,165,776 | 1/1965 | Tuseth . | |
| 3,536,410 | 10/1970 | Wargoe . | |
| 4,580,588 | 4/1986 | Swope, Jr. | 401/268 X |

FOREIGN PATENT DOCUMENTS

| | | |
|---|---|---|
| 0392987 | 10/1990 | European Pat. Off. . |
| 2554331 | 5/1985 | France . |
| 2583625 | 12/1986 | France . |
| 2629989 | 10/1989 | France . |

*Primary Examiner*—Steven A. Bratlie
*Attorney, Agent, or Firm*—Darby & Darby

[57] ABSTRACT

A toothbrush comprises a handle having a first end and a second end. The handle has a recess disposed in the first end that includes at least one pair of grooves. The grooves increase in width from the first end to the second end. A container has a parametric wing. A strip is removably attached to the parametric wing. The parametric wing and the strip are received in the at least one pair of grooves. The strip comprises an elongated sheet of material that is folded over upon itself and includes an end portion which projects beyond the first end of the handle.

4 Claims, 2 Drawing Sheets

TOOTHBRUSH WITH SLIDE IN SUPPLY

OBJECT OF THE INVENTION

The present invention relates to a toothbrush and more specifically to a series of improvements introduced in the type of brush whose head includes, in the surface opposite to that of the bristles, a container with a dose of toothpaste, permitting the toothpaste to come out towards the bristles through and opening or through holes adequately made in the head.

The improvements include freeing the container from the head, as well as on the guide means of the container itself for the connection and, disconnection thereof and on its particular system of closing the containers which permits toothpaste to be applied without having to previously free the container from the head to carry out the uncovering.

BACKGROUND OF THE INVENTION

Various types of toothbrushes that one way or the other include toothpaste are known. Hence, toothbrushes that contain toothpaste between the bristles of the same are known, the toothpaste being freeze-dried or in powder from, in such a way that upon using the brush and after wetting the bristles, toothpaste will be obtained.

Other brushes include the toothpaste in the handle itself of the brush and by means of some capillaries or holes that run longitudinally along the handle and head of the same, toothpaste can be obtained on the bristles of the brush.

Most of these toothbrushes are disposable and tend to be marketed mainly in vending machines, hotels, etc. These toothbrushes normally have a wrapper or bag protecting the same, which after opening the wrapper, the brush can be used. This wrapper or bag is used as the seal.

SUMMARY OF THE INVENTION

The brush of the present invention, as it is conventional, is comprised of a handle whose end broadens, the end having a recess with a pair of grooves facing each other which form some guides for a replaceable container and a head with the bristles upon the grooves having some flanges which fits into the guides.

The container as well as the head with the bristles are independent and replaceable and disposable elements.

The container, having the shape of an elongated bowl of elastic material, has a bottom adhesive strip, that seals the outlet of the toothpaste contained inside of the container. The strip is removed when the brush is to be used.

The head is pressure fit on the brush, on the other side of the container and on a pair of bottom guides. The head has one or several central openings to let the toothpaste come out when pressure is applied to the container.

The container is placed on the brush by sliding it between the upper guides, upon them normally reaching the end of the same, while the head will pressure fit on the bottom ones. This embodiment permits the container to be removed after part or all of the toothpaste inside the same has been used up, in order to facilitate use of the same.

As the handle, container and head are replaceable elements, they will be advantageously marketed on a support that will contain a handle and various container replacements.

This support will be wrapped in a protective or retractile plastic container to offer optimal conditions of hygiene and storage.

In a variation of the above described embodiment, the brush includes means provided in the container to allow it to be uncovered with the head being assembled thus avoiding possible contact of one's fingers with the toothpaste and ensuring that the toothpaste does not come into contact with any element or object, not even the environment, until it is released onto the bristles.

In this sense, it has been provided that the closure of the base corresponding to the toothpaste container is comprised of a double strip. The bottom or most external strip projects from one of the ends forming a pulling tongue, which permits, once the toothpaste container has been duly assembled and positioned on the head of the brush, the tongue to be pulled and the strip begins to come loose from the base of the container, producing the opening of the container and subsequent release of toothpaste on the bristles, by pressing on the outer or top part of the container itself.

Another important characteristic of the present invention is that the guides of the head for the assembly and positioning of the toothpaste container progressively broadens or widens towards the inside for the purpose of not posing problems of carrying out the uncovering operation, in other words, to permit the bottom double strip of the base of the container to be removed by pulling on the same.

DESCRIPTION OF THE DRAWINGS

The brush and the parts of characteristics thereof have been represented on the attached sheets of drawings. The different figures show the following.

DESCRIPTION OF THE PREFERRED EMBODIMENTS

Figure 1:
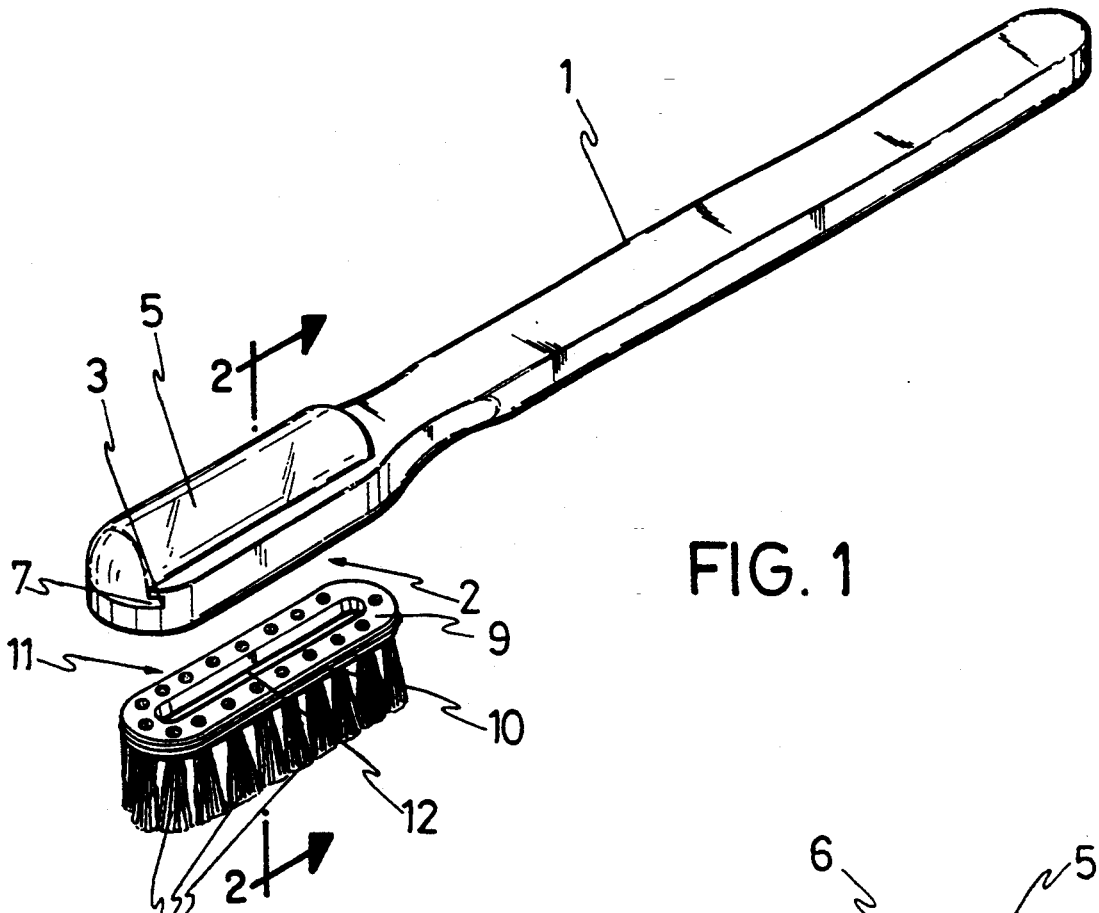
FIG. 1 corresponds to a perspective view of the brush of the invention with the head freed.
Figure 2:
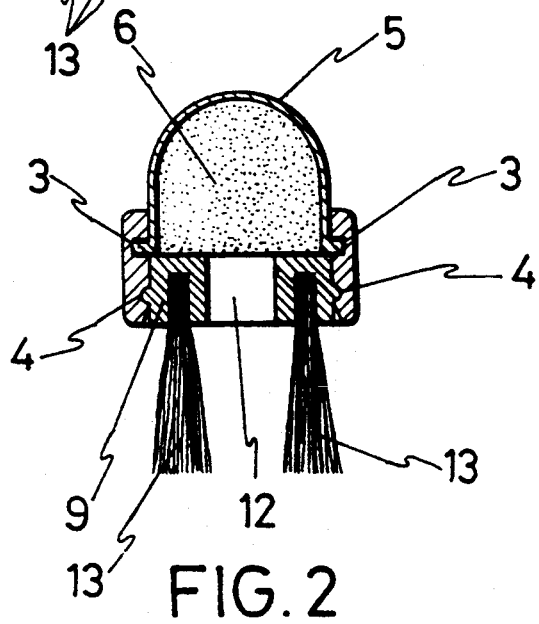
FIG. 2 corresponds to a cross-section of the head of the brush with the container coupled thereto, said section corresponding to section 2—2 of FIG. 1.
Figure 3:
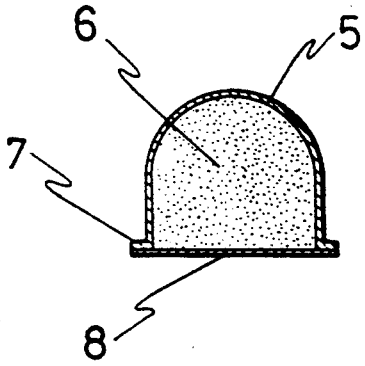
FIG. 3 shows a cross-section of the toothpaste container.

In the embodiment shown in FIGS. 1, 2 and 3, the brush of the present invention comprises a handle 1 whose end considered as the front end includes a broadening area 2 in which there is a groove or recess. The recess has side inside walls which have some longitudinal channels or grooves 3 and 4 determining both guides. The top guides 3 reach the end of the brush. Side flanges 7 of the toothpaste container 5 slide along the guides 3. Thus, toothpaste container 5 slides in the broadened end 2 of the handle. Container 5 is closed at the bottom by means of a strip 8 that will be freed by pulling and removing it immediately before the container 6 is assembled in the broadened end 2 so that the brush can be used. Since the pulling and corresponding freeing of the closing strip 8 will entail the release of toothpaste 6 so that by pressing on the top side of the container 5 toothpaste comes out towards the head itself which contains the bristles.

Head 9 is placed on the part or broadened end 2, by sliding on the guides 4 of the flanges 10 and 11 and after having assembled and opened the container 5.

Due to the fact that the head 9 has a central opening 12, the toothpaste will pass through it and will reach the corresponding bristles 13.

After the cited operation and in order to carry out the corresponding use by the user, it will suffice to draw back the container 5 with regard to the broadened end 2, for the purpose of this not being bothersome or being an obstacle for use of the brush.

Figure 4:
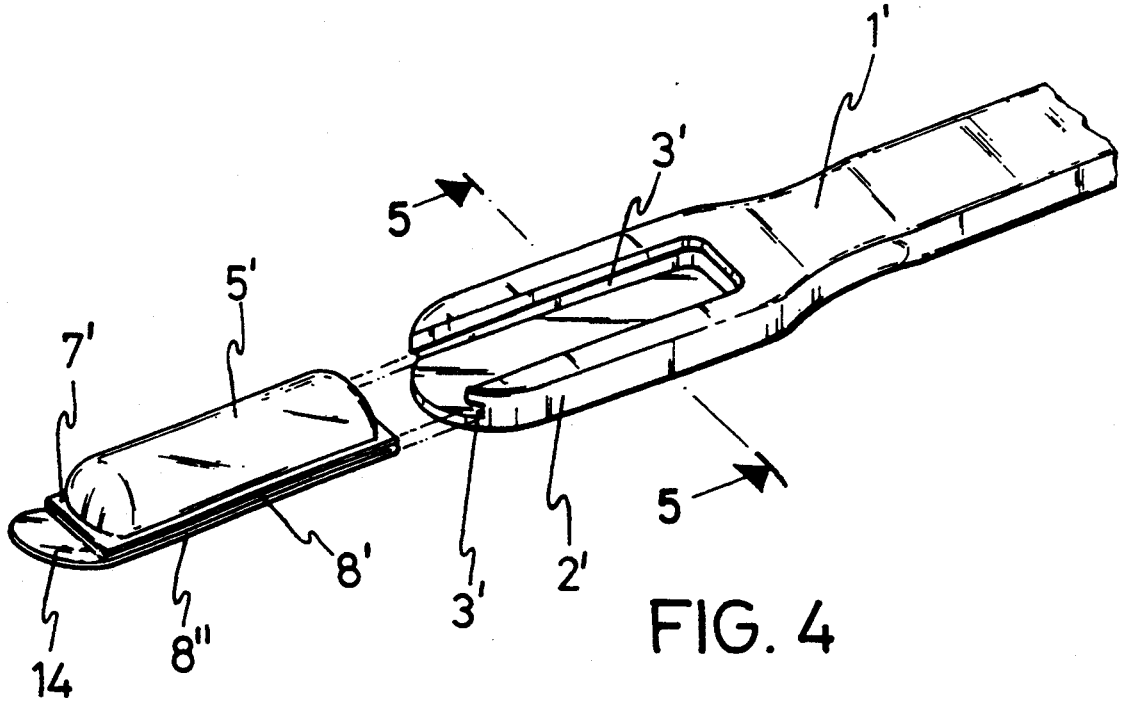
FIG. 4 shows a second embodiment of the brush, whose container can be opened after it has been assembled on the head.
Figure 5:
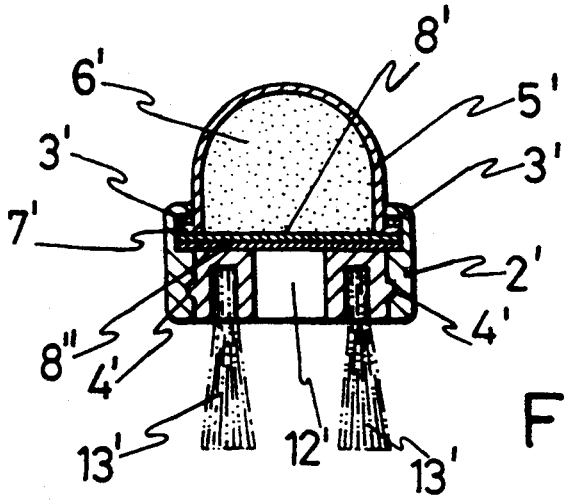
FIG. 5 shows a cross-section view of the head of the brush with the container assembled on the same, according to the embodiment represented in the above figure. The section corresponds to section 5—5 of FIG. 4.
Figure 6:
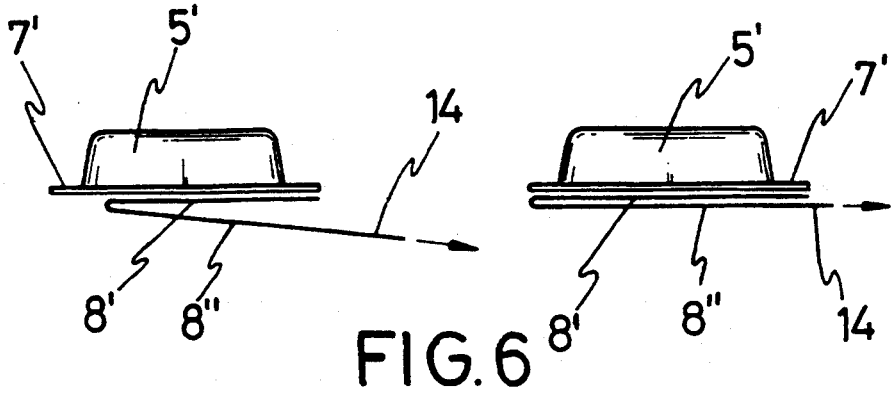
FIG. 6 shows the toothpaste container, in accordance with the second embodiment cited in FIGS. 4 and 5. The cited container is shown in a closed position and in a partially open position.

FIGS. 4, 5 and 6 show the second embodiment of the present invention, in which the brush has a handle 1', broadened end 2', guides 3' and 4' for the container 5' of the toothpaste 6' and for the head 9' having the bristles 13' and provided with an opening 12' through which the toothpaste 6' passes towards the bristles 13'.

In this embodiment, the bottom closure of the container 5' is effected by a strip 8' itself and fixed to the perimetric wing 7' of the container 5', whose sides titan sliding means along the guides 3'. The folded over portion of the strip 8' corresponds to the reference 8'', and remains superimposed by the outside of the inner strip 8' and extends by its free end forming a tongue 14.

In other words, the perimetric wing 7' along with the double closure strip 8'-8'' are assembled and slide upon the guides 3' of the head 9' leaving the tongue 14 emerging outside or protruding beyond the broadened end 2' of the handle 1. To uncover the container, one pulls the tongue 14 with one's fingers. This pulling will involve the release of the strip part 8' that is abutted to the perimetric base 7', producing the uncovering of the container 5'. The progressive increase of width of the side guides 3' of the head 9' is foreseen precisely to permit the pulling and removal operation of the double strip 8'-8'', since if the container is mounted tight upon the guides 3', there would be no possibility of removing the cited double strip 8'-8''.

In this way, toothpaste 6' from container 5' can be assembled upon the head 9' and once it has been adequately positioned the opening thereof can be carrier out. In other words, the release and freeing of the double strip 8'-8'', which involves the uncovering of the container 5', can be carried out with the container mounted to the handle. Once the container 5' is opened, the user can, upon pressing on the cover part of the convex part of the container, produce the release of toothpaste through the hole 12' to cover the bristles 13'. Thus, the brush remains ready to be used so that the user can brush his teeth.

I claim:

1. A toothbrush comprising:

a handle having a first end and a second end, said handle having a recess disposed in said first end that includes at least one pair of grooves, said grooves increasing in width from said first end to said second end;

a container having a parametric wing; and a strip removably attached to said parametric wing, said parametric wing and said strip being received in said at least one pair of grooves, said strip comprising an elongated sheet of material that is folded over upon itself and includes an end portion which projects beyond said first end of said handle.

2. The toothbrush according to claim 1, further including a head being removably attached to said first end of said handle.

3. The toothbrush according to claim 2, further including a plurality of bristles connected to said head.

4. The toothbrush according to claim 3, wherein said head includes a central opening.

* * * * *